US012091232B2

(12) United States Patent
Huffer

(10) Patent No.: US 12,091,232 B2
(45) Date of Patent: Sep. 17, 2024

(54) RETORTABLE SELF-HEATING FOOD CONTAINER WITH AIR ACCESS STRUCTURE

(71) Applicant: SONOCO DEVELOPMENT, INC., Hartsville, SC (US)

(72) Inventor: Scott William Huffer, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 1298 days.

(21) Appl. No.: 16/730,590

(22) Filed: Dec. 30, 2019

(65) Prior Publication Data

US 2020/0130919 A1 Apr. 30, 2020

Related U.S. Application Data

(62) Division of application No. 14/689,118, filed on Apr. 17, 2015, now Pat. No. 10,549,899.

(51) Int. Cl.
*B65D 81/34* (2006.01)

(52) U.S. Cl.
CPC .... *B65D 81/3484* (2013.01); *B65D 2205/025* (2013.01)

(58) Field of Classification Search
CPC ..... B65D 2205/025; B65D 81/3484
See application file for complete search history.

(56) References Cited

U.S. PATENT DOCUMENTS

| | | | | |
|---|---|---|---|---|
| 3,287,140 | A | 11/1966 | Brussell | |
| 5,180,599 | A | 1/1993 | Feldmeier et al. | |
| 5,465,707 | A | 11/1995 | Fulcher | |
| 5,932,798 | A * | 8/1999 | Rea | G01M 3/3281 73/49.8 |
| 6,289,889 | B1 | 9/2001 | Bell et al. | |
| 6,644,383 | B2 | 1/2003 | Joseph et al. | |
| 8,039,070 | B1 | 10/2011 | Sawall et al. | |
| 8,178,207 | B2 * | 5/2012 | Mizuno | C09J 183/04 428/447 |
| 8,397,914 | B1 | 3/2013 | Janichek, Jr. et al. | |
| 8,545,099 | B2 * | 10/2013 | Davis | B65D 75/5833 383/203 |
| 9,024,360 | B1 | 5/2015 | Huffer et al. | |
| 9,850,056 | B2 | 12/2017 | Shaw et al. | |
| 2008/0128431 | A1 | 6/2008 | Gradzewicz | |
| 2009/0297745 | A1 | 12/2009 | Karsten et al. | |
| 2011/0103718 | A1 | 5/2011 | Bosman | |
| 2020/0130919 | A1 * | 4/2020 | Huffer | B65D 81/3484 |

FOREIGN PATENT DOCUMENTS

| | | | | |
|---|---|---|---|---|
| CA | 2713572 | A1 * | 4/2011 | B65D 75/008 |
| WO | 2012008064 | A1 | 1/2012 | |

* cited by examiner

*Primary Examiner* — Sonya M Sengupta
(74) *Attorney, Agent, or Firm* — von Briesen & Roper, s.c.

(57) ABSTRACT

A flexible, self-heating food container capable of withstanding high temperatures is provided. The container comprises a two-layer laminate structure having an air access flap that can be lifted by the consumer to allow air to enter the part of the container where an exothermic reaction takes place.

20 Claims, 2 Drawing Sheets

RETORTABLE SELF-HEATING FOOD CONTAINER WITH AIR ACCESS STRUCTURE

CROSS-REFERENCE TO RELATED APPLICATION

This application is a divisional of U.S. patent application Ser. No. 14/689,118, filed Apr. 17, 2015, which is hereby incorporated by reference in its entirety to provide continuity of disclosure.

BACKGROUND OF THE INVENTION

Field of the Invention

This invention patent relates to a self-heating food container. More particularly, this invention relates to a flexible, self-heating food container featuring a single use air access flap and capable of withstanding high (retort) temperatures.

Description of the Related Art

Flexible laminate packaging can be used as an alternative to cans to hold liquids and other consumables. The packages can be filled hot or the contents can be sterilized by retorting. Retorting typically involves heating the contents to 240-250 degrees for several minutes to kill microorganisms inside the package. The laminated film acts as an air and oxygen barrier to keep the contents fresh.

Self-heating packages are packages that can heat the contents without the use of an external heating means. One type of self-heating package uses an exothermic chemical reaction to heat the package contents. Self-heating packages may have a compartment for holding the consumable contents and one or more separate compartments for holding the chemical reagent(s) needed for the exothermic reaction that heats the contents. If the exothermic reaction requires oxygen, the package must include means for allowing air to enter the reaction space.

One means to introduce air into a self-heating package is the use of a flap that, when lifted or otherwise removed, exposes the interior to air. Thus there exists a need for a one-time opening feature in a retortable, self-heating package for allowing air access to activate the chemical component(s) for self-heating purposes. The present disclosure addresses this need.

BRIEF SUMMARY OF THE INVENTION

The present invention is a flexible, self-heating food package capable of withstanding high temperatures. The package comprises a two-layer laminate structure having an air access flap that can be lifted by the consumer to allow air to enter the part of the package where an exothermic reaction takes place.

In one aspect, the package comprises a flexible laminate film having a bottom layer and a top layer substantially coextensive with and laminated to the bottom layer.

The bottom layer comprises a substrate and a continuous resinous frangible skin layer located on an outer facing surface of the substrate between the substrate and the top layer. The bottom layer is precision scored to form one or more undercuts, each undercut defining a die cut section or plug. The top layer is precision scored to form an overcut which defines a periphery of a flap. The frangible skin layer is located within the flap periphery and may be located outside the flap periphery.

When the flap is lifted, the top layer separates from the bottom layer and simultaneously pulls out the die cut sections, creating the air holes in the bottom layer through which air can pass.

DETAILED DESCRIPTION OF THE INVENTION

Figure 1:
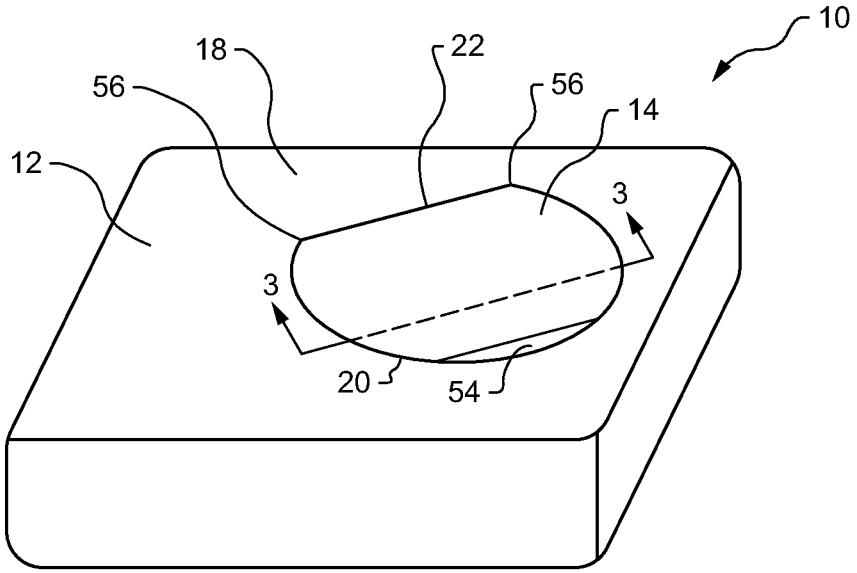
FIG. 1 is a perspective view of a flexible self-heating package according to the disclosure.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

Turning to the drawings, there is shown in FIG. 1 a flexible package 10 according to the disclosure. The package 10 is made from a two-layer laminate film 12 and has an air access flap 14 that can be lifted by the consumer to allow air to enter a compartment where an exothermic reaction takes place. The laminate film 12 acts as an air and oxygen barrier to keep the contents fresh.

The laminate film 12, described in more detail below with respect to FIGS. 3 and 4, comprises a bottom layer 16 and a top layer 18 bonded together with a permanent adhesive 34. The top layer 18 is precision scored to form an overcut 20 which defines the periphery 20 of the flap 14. In FIG. 1 the flap 14 is substantially semi-circular and is attached to the rest of the package 10 along a hinge line 22, although the flap 14 may be any suitable shape.

The package 10 can be used to hold food that requires heating before being consumed. The package 10 may have multiple internal compartments, including one or more for food (not shown in the figures) and one or more for the chemical reagents (aka heating agents) that cause the exothermic reaction when exposed to air. After the contents and heating agents are placed within their respective compartments inside the flexible package 10, the package 10 is sealed shut. The sealing may be accomplished by crimping, folding or otherwise closing off the ends and then exposing the ends to a temperature sufficient to at least partially melt the film so that it fuses or welds together to form a heat seal if heat sealing is used. Alternatively, and without limitation, the ends may be sealed using cold sealing.

The package 10 can be filled hot, or the contents can be sterilized by retorting. Retorting typically involves heating the contents to 240-250 degrees for several minutes to kill microorganisms inside the package 10.

Figure 2:
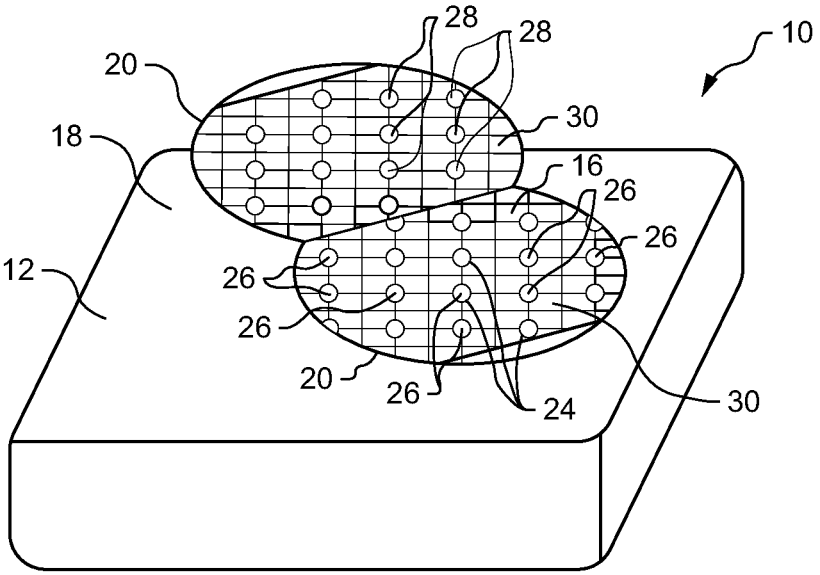
FIG. 2 is a perspective view of the package of FIG. 1 shown after a flap has been lifted to allow air flow into a compartment.

FIG. 2 is a perspective view of the package 10 of FIG. 1 shown after the flap 14 has been lifted to allow air flow into a compartment. The bottom layer 16 is exposed where the flap 14 has been lifted. The bottom layer 16 is precision scored at a number of locations to form undercuts 24 which will define air holes 26 when the flap 14 is lifted. The undercuts 24 may extend through both the substrate 16 and frangible skin layer 30 and optionally into the permanent adhesive 34, or just through the substrate 16. As explained more fully below, lifting the flap 14 causes plugs 28 to be removed from the bottom layer 16, creating the air holes 26 in the bottom layer 16. The air holes 26 communicate with the compartment(s) holding the chemical reagents.

The frangible skin layer 30, indicated in cross-hatching in FIG. 2, is located between the bottom layer 16 and the top layer 18. The frangible skin layer 30 may be a coextruded skin layer and may be bonded to the permanent adhesive 34 during the lamination process. This frangible skin layer 30 splits apart when the flap 14 is lifted from the bottom layer 16, leaving some of the frangible skin layer 30 affixed to both the flap 14 and the bottom layer 16. The frangible skin layer 30 preferably is limited to the area within the overcut 20. Outside this area the bottom layer 16 and the top layer 18 may be laminated together with the permanent adhesive 34.

The food or other contents may be accessed by lifting a second flap, not shown in the figures, which may also adhered to the bottom layer 16, or by opening the food compartment(s) by other means.

Figure 3:
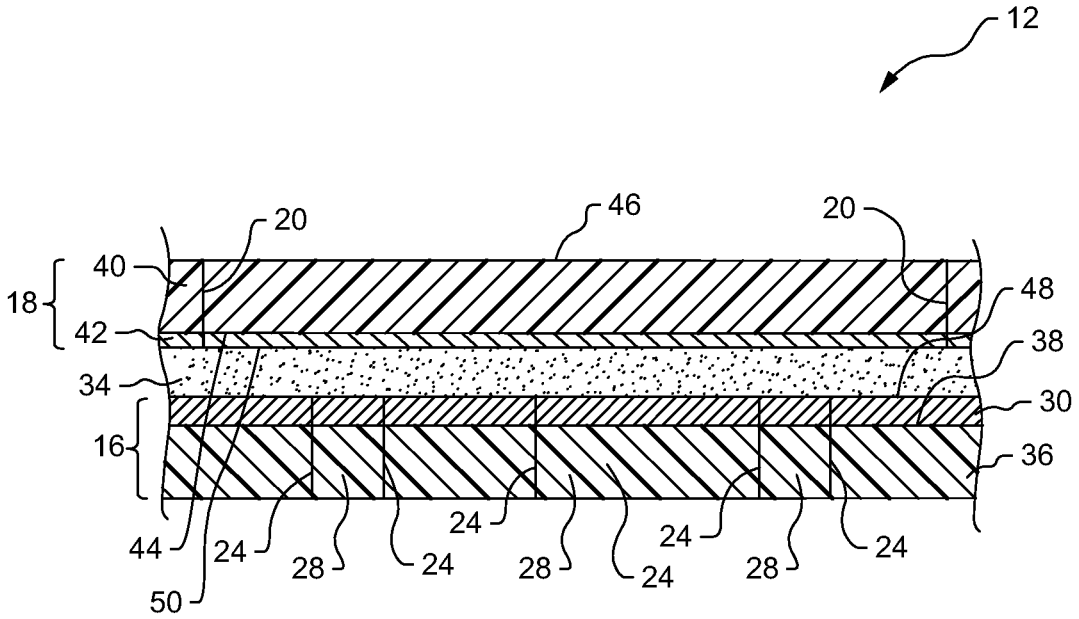
FIG. 3 is a cross-sectional view of the package of FIG. 1 taken along line 3-3.

FIG. 3 is a cross-sectional of the package 10 of FIG. 1 taken along line 3-3, showing one embodiment of a robust two-ply laminate film 12 for use in making the retortable, self-heating package 10. The laminate film 12 comprises, from the inside out, a bottom layer 16, a heat seal or permanent adhesive 34 and a top layer 18.

The bottom layer 16 may comprise a substrate 36 and a coextruded frangible skin layer 30. The substrate 36 may be cast polypropylene (CPP), high density polyethylene (HDPE), low density polyethylene (LDPE), linear low density polyethylene (LLDPE) or any suitable material. The frangible skin layer 30 is coextruded onto an outer facing surface 38 of the substrate 16. The frangible skin layer 30 may be formed front a resinous material and a contaminant that weakens the resinous material in the Z-direction, that is, the direction orthogonal to the plane of the laminate film 12.

The coextruded bottom layer 16 is laminated to the top layer 18 by the permanent adhesive 34 so that the frangible skin layer 30 is interposed between the substrate 16 and the top layer 18. The permanent adhesive 34 may be a heat seal or any suitable adhesive, and may be continuous or pattern applied.

The top layer 18 may include a barrier layer 40 and an ink layer 42. The barrier layer 40 may be transparent metallized polyethylene terephthalate (PET) film and may act as an oxygen barrier. The barrier layer 40 has an inner facing surface 44 and an outer facing surface 46. The inner facing surface 44 of the barrier layer 40 may be treated so that it can accept the ink layer 42, preferably in the form of reverse printed graphics.

Still referring to FIG. 3, the bottom layer 16 is precision scored at a number of locations to form undercuts 24 which will define the air holes 26 when the flap 14 is lifted.

The frangible skin layer 30 does not significantly degrade upon exposure to retort temperatures. More specifically, the frangible skin layer 30 does not significantly degrade upon exposure to 240-250 degree temperatures for several minutes. This allows the package 10 to be subjected to retort temperatures within compromising the integrity of the air access flap 14.

Figure 4:
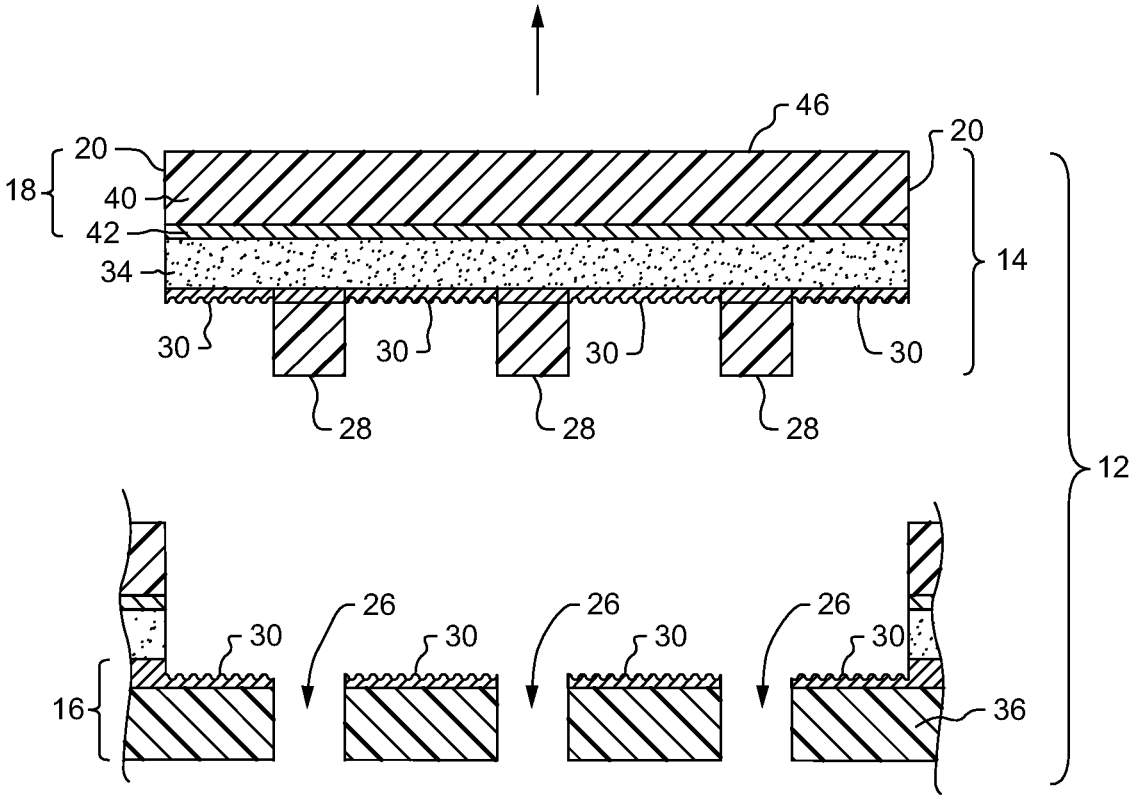
FIG. 4 is the same cross-sectional view as FIG. 3 but after the flap has been lifted.

FIG. 4 is cross-sectional view of FIG. 3 after the flap 14 has been lifted. When the flap 14 is lifted, the top layer 18 and permanent adhesive 34 separate from the substrate 36 at the peelable interface (frangible skin layer 30) and simultaneously pull out die cut sections (plugs) 28, creating the air holes 26 in the bottom layer 16 through which air can pass.

More specifically, when the flap 14 is lifted, the two-layer laminate film 12 will fail at the frangible skin layer 30 but remain intact within the areas defined by the undercuts 24 (and outside the overcut 20). The frangible skin layer 30 outside the areas defined by the undercuts 24 (and within the larger area defined by the overcut 20) splits, and may leave some of the frangible skin layer 30 on both the top layer 18 and the substrate 16. The intact portions of the laminate film 12 within the areas defined by the undercuts 24 include plugs 28 which have been lifted from the bottom layer 16. The coextruded bottom layer 16 remains as a continuous sheet except for the air holes 26 where the plugs 8 have been lifted away.

The peel-away air access flap 14 is a one-time use feature because the frangible skin layer 30, once split apart, does not adhere well to itself. What is left after the flap 14 is peeled away is a bottom layer 16 with the flap 14 removed and air holes 26 exposed.

In another aspect of the disclosure a method of making a flexible self-heating package 10 is provided. The method may comprise the following steps:

A bottom layer 16 is made by coextruding a substrate 36 and a frangible skin layer 30.

An optional ink layer 42 may be applied to the inner facing surface 44 of the barrier layer 40.

The permanent adhesive 34 may be pattern applied onto the outer facing surface 48 of the bottom layer 16 or onto the inner facing surface 50 of the ink layer 42 or, if there is no ink layer 42, onto the inner facing surface 44 of the barrier layer 40. Preferably the permanent adhesive 34 does not cover a small area 52 of the bottom layer 16 which will be overlaid with a lift tab 54 (FIG. 2) so that the lift tab 54 is not adhered to the bottom layer 16. Typically the permanent adhesive 34 is not applied to a small area 52 within the overcut 20 adjacent the overcut 20 and opposite the hinge line 22.

Next, the "coex" or bottom layer 16 is adhered to the top layer 18 with the permanent adhesive 34 to produce the laminate film 12. This may be accomplished using a laminating machine comprising two rollers forming a nip therebetween. The bottom layer 16 and the top layer 18 should be substantially coextensive with each other during the laminating process. For example, if the layers 16, 18 are rectangular, the width and length of the bottom layer 16 should match the width and length of the top layer 18. The laminate 12 film may be rectangular or any shape suitable for forming the desired flexible package 10.

Next, a roll of the laminate film 12 is fed to a first scoring station where small, preferably circular undercuts 24 are scored in the bottom layer 16. The undercuts 24 may be formed with a laser, with a die cutting machine or by any suitable means and may extend through the entire thickness or almost the entire thickness of the bottom layer 16.

The roll of laminate film 12 is fed to a second scoring station where an overcut 20 is formed in an outer facing surface 46 of the barrier layer 40. The overcut 20 preferably is formed with a laser, with a die cutting machine or by any suitable means and may extend through the entire thickness or almost the entire thickness of the top layer 18.

The overcut 20 may be any suitable shape. In the illustrated example, the overcut 20 forms a semi-circle pattern surrounding the undercuts 24. The overcut 20 terminates in opposing ends 56 which form the ends 56 of a hinge line 22 along which the flap 14 is permanently affixed to the top layer 18. Alternatively, the overcut 20 may be a closed two-dimensional shape so that the flap 14 is completely removable from the package 10.

The laminate film 12 can now be rolled up for use in packaging products. For example and without limitation, the laminate film 12 can be used to wrap food or other contents that require heating. A heating agent may be placed in a first compartment sealed by the flap 14. After the food that requires heating is placed inside a second compartment within the flexible package 10, the package is sealed to create the filled package 10. In yet another aspect of the disclosure a method of using the flexible self-heating package 10 is provided comprising the steps of:

Lifting the flap 14 to expose the heating agents to air and thus start the exothermic reaction which heats the edible contents.

Opening the food compartment in any suitable manner, for example, by lifting another flap (not shown) or by opening an end of the package 10.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A method of making a flexible self-heating package comprising the steps of:

coextruding a substrate and a frangible skin layer to create a bottom layer;

providing a top layer of flexible material in sheet form;

joining the bottom layer to the top layer with a permanent adhesive;

scoring a plurality of undercuts in the bottom layer;

scoring an overcut in the top layer that substantially surrounds the undercuts and defines a flap to create a scored laminate film, wherein each of the plurality of undercuts defines a die cut section in the bottom layer that separates from the bottom layer when the flap is separated from the bottom layer to form an air hole in the bottom layer; and forming a flexible-self-heating package with the scored laminate film.

2. The method of claim 1 comprising the additional step of:

placing a heating agent in a first compartment sealed by the flap and placing food that requires heating in a second compartment.

3. The method of claim 1 wherein, before the joining step, applying the permanent adhesive to either the bottom layer or the top layer.

4. The method of claim 1 wherein the permanent adhesive is not applied to a small area within the overcut adjacent the overcut.

5. The method of claim 4 wherein the overcut terminates in opposing ends which form the ends of a hinge line, and wherein the permanent adhesive is not applied to a small area within the overcut adjacent the overcut and opposite the hinge line.

6. The method of claim 1 wherein scoring the plurality of undercuts comprises scoring the plurality of undercuts through the substrate and the frangible skin layer to the permanent adhesive.

7. The method of claim 1 wherein the plurality of undercuts do not extend into the permanent adhesive.

8. A method of making a flexible self-heating package comprising the steps of:

coextruding a substrate and a frangible skin layer to create a bottom layer;

providing a top layer of flexible material in sheet form;

joining the bottom layer to the top layer with a permanent adhesive, wherein the frangible skin layer is in direct contact with the permanent adhesive;

scoring a plurality of undercuts in the bottom layer;

scoring an overcut in the top layer that substantially surrounds the undercuts and defines a flap to create a scored laminate film, wherein each of the plurality of undercuts defines a die cut section in the bottom layer that separates from the bottom layer when the flap is separated from the bottom layer to form an air hole in the bottom layer; and forming a flexible-self-heating package with the scored laminate film.

9. The method of claim 8 comprising the additional step of:

placing a heating agent in a first compartment sealed by the flap and placing food that requires heating in a second compartment.

10. The method of claim 8 wherein, before the joining step, applying the permanent adhesive to either the bottom layer or the top layer.

11. The method of claim 8 wherein the permanent adhesive is not applied to a small area within the overcut adjacent the overcut.

12. The method of claim 11 wherein the overcut terminates in opposing ends which form the ends of a hinge line, and wherein the permanent adhesive is not applied to a small area within the overcut adjacent the overcut and opposite the hinge line.

13. The method of claim 8 wherein scoring the plurality of undercuts comprises scoring the plurality of undercuts through the substrate and the frangible skin layer to the permanent adhesive.

14. The method of claim 13 wherein the plurality of undercuts do not extend into the permanent adhesive.

15. A method of making a flexible self-heating package comprising the steps of:

coextruding a substrate and a frangible skin layer to create a bottom layer;

providing a top layer of flexible material in sheet form;

joining the bottom layer to the top layer with a permanent adhesive;

scoring a plurality of undercuts in the substrate;

scoring an overcut in the top layer that substantially surrounds the undercuts and defines a flap to create a scored laminate film, wherein each of the plurality of undercuts defines a die cut section in the bottom layer that separates from the bottom layer when the flap is separated from the bottom layer to form an air hole in the bottom layer, and forming a flexible-self-heating package with the scored laminate film.

16. The method of claim 15 comprising the additional step of:

placing a heating agent in a first compartment sealed by the flap and placing food that requires heating in a second compartment.

17. The method of claim 15 wherein, before the joining step, applying the permanent adhesive to either the bottom layer or the top layer.

18. The method of claim 15 wherein the overcut terminates in opposing ends which form the ends of a hinge line, and wherein the permanent adhesive is not applied to a small area within the overcut adjacent the overcut and opposite the hinge line.

19. The method of claim 15 wherein the frangible skin layer is in direct contact with the permanent adhesive.

20. The method of claim 15 wherein scoring the plurality of undercuts comprises scoring the plurality of undercuts through the substrate and the frangible skin layer to the permanent adhesive.

* * * * *